US012590431B2

(12) United States Patent
Park et al.

(10) Patent No.: US 12,590,431 B2
(45) Date of Patent: Mar. 31, 2026

(54) PORTABLE OIL SKIMMER

(71) Applicant: KOAI CO., LTD., Busan (KR)

(72) Inventors: Kyung-taek Park, Busan (KR); Ho-sin Lee, Busan (KR); Seul-gi Ju, Gimhae-si (KR); Dong-yeop Lee, Busan (KR)

(73) Assignee: KOAI CO., LTD., Busan (KR)

( * ) Notice: Subject to any disclaimer, the term of this patent is extended or adjusted under 35 U.S.C. 154(b) by 366 days.

(21) Appl. No.: 18/213,922

(22) Filed: Jun. 26, 2023

(65) Prior Publication Data

US 2024/0218624 A1 Jul. 4, 2024

(30) Foreign Application Priority Data

Dec. 28, 2022 (KR) ..... 10-2022-0186744

(51) Int. Cl.
*E02B 15/04* (2006.01)
*E02B 15/10* (2006.01)

(52) U.S. Cl.
CPC ..... *E02B 15/048* (2013.01); *E02B 15/102* (2013.01); *E02B 15/103* (2013.01)

(58) Field of Classification Search
CPC .... E02B 15/048; E02B 15/102; E02B 15/103; E02B 15/045; E02B 15/046; E02B 15/10; E02B 15/106; E02B 15/108; Y02A 20/204
USPC ..... 210/242.3
See application file for complete search history.

(56) References Cited

U.S. PATENT DOCUMENTS 5,089,179 A * 2/1992 von Nordenskjold .... C02F 3/20 261/81
2018/0038374 A1* 2/2018 Jaeger ..... A62B 18/086

FOREIGN PATENT DOCUMENTS

CN 207320891 U * 5/2018
CN 215593940 U * 1/2022
KR 10-1547961 B1 8/2015
KR 101985294 B1 * 6/2019 ..... E02B 15/103
KR 102269673 B1 * 6/2021 ..... E02B 15/103

* cited by examiner

*Primary Examiner* — Ekandra S. Miller-Cruz
(74) *Attorney, Agent, or Firm* — Revolution IP, PLLC

(57) ABSTRACT

A portable oil skimmer includes a collection unit configured to collect spilled oil while floating on the surface of the ocean. The collection unit includes a main body configured to allow a first oil-skimming member to be rotatably mounted on the front end thereof, a second oil-skimming member to be rotatably mounted on the rear end thereof, and a pipe to be connected to the upper portion thereof so as to communicate with the interior thereof, a pair of buoyant bodies mounted on two side surfaces of the main body, with the main body interposed therebetween, and an oil pump disposed in the main body and configured to convey oil collected by the first oil-skimming member and the second oil-skimming member to the outside of the main body through the pipe.

7 Claims, 8 Drawing Sheets

PORTABLE OIL SKIMMER

BACKGROUND OF THE INVENTION

Field of the Invention

The present invention relates to a portable oil skimmer.

Description of the Related Art

Conventionally, when an oil spill accident occurs in the ocean, an oil absorbent or an oil skimmer is used to prevent spread of spilled oil. However, use of an oil absorbent causes workers to suffer from a significant amount of fatigue and incurs post-processing cost. In the case of using an oil skimmer, it is generally difficult to store and carry the oil skimmer due to a large volume thereof, and it is also difficult for a single worker to operate the oil skimmer.

As technology for solving the above problems, KR 10-1547961 discloses a portable oil-water separating apparatus. However, according to this conventional apparatus, most components of a power system are provided in a backpack, which makes the backpack heavy, thus deteriorating work efficiency. Further, since there is a limitation on the amount of power that can be supplied to the backpack from a battery, time available for work is short.

RELATED ART DOCUMENT

Patent Document

KR 10-1547961

SUMMARY OF THE INVENTION

The present invention has been made to solve the above problems, and it is an object of the present invention to provide a portable oil skimmer capable of greatly reducing the weight of a backpack to be worn by a worker, thereby increasing work efficiency, and capable of increasing the amount of power to be supplied to a collection unit, thereby enabling a worker to quickly perform an oil-collecting task for a long time period.

However, the objects to be accomplished by the invention are not limited to the above-mentioned objects, and other objects not mentioned herein will be clearly understood by those skilled in the art from the following description.

In accordance with the present invention, the above and other objects can be accomplished by the provision of a portable oil skimmer in which an oil pump is disposed in a collection unit configured to collect spilled oil while floating on the surface of the ocean.

The portable oil skimmer according to an embodiment of the present invention may include a collection unit configured to collect spilled oil while floating on the surface of the ocean. The collection unit may include a main body configured to allow a first oil-skimming member to be rotatably mounted on the front end thereof, a second oil-skimming member to be rotatably mounted on the rear end thereof, and a pipe to be connected to the upper portion thereof so as to communicate with the interior thereof, a pair of buoyant bodies mounted on two side surfaces of the main body, with the main body interposed therebetween, and an oil pump disposed in the main body and configured to convey oil collected by the first oil-skimming member and the second oil-skimming member to the outside of the main body through the pipe.

Each of the first oil-skimming member and the second oil-skimming member may be implemented in at least one of a disc type or a drum type, and may be formed so as to be detachably coupled to the main body.

The pair of buoyant bodies may include a first buoyant body mounted on the left surface of the main body and a second buoyant body formed to have the same shape as the first buoyant body and mounted on the right surface of the main body in a state of being rotated 180 degrees from the first buoyant body about an axis extending in an upward-downward direction.

The portable oil skimmer according to an embodiment of the present invention may further include a first motor configured to generate rotational driving force to be supplied to the first oil-skimming member, a first battery configured to supply power to the first motor, a first power transmission unit configured to transmit rotational driving force generated by the first motor to the first oil-skimming member, a second motor configured to generate rotational driving force to be supplied to the second oil-skimming member, a second battery configured to supply power to the transmission unit second motor, and a second power configured to transmit rotational driving force generated by the second motor to the second oil-skimming member. The first motor, the first battery, and the first power transmission unit may be disposed in a first space defined in the first buoyant body, and the second motor, the second battery, and the second power transmission unit may be disposed in a second space defined in the second buoyant body.

The first buoyant body may include a plurality of protruding portions protruding from the inner side surface thereof toward the first space.

The first buoyant body may include a lower portion defining the first space having an open upper side and an upper portion coupled to the lower portion to cover the open upper side of the first space. The protruding portions may protrude in a direction from grooves formed in the lower portion for coupling to the upper portion toward the first space.

The lower portion may be provided on the upper surface thereof with a rubber member, which protrudes upward along the periphery of the first space, and the upper portion may be coupled to the lower portion in a state of receiving the rubber member therein.

The portable oil skimmer according to an embodiment of the present t invention may further include a backpack accommodating a sub-battery therein. At least one of the first oil-skimming member or the second oil-skimming member may receive power from the sub-battery in a state of being electrically connected to the sub-battery via a waterproof connector formed on the collection unit.

The portable oil skimmer according to an embodiment of the present invention may further backpack accommodating a converter configured to convert a type of power. At least one of the first oil-skimming member or the second oil-skimming member may be driven by power output from the converter in a state of being electrically connected to the converter via a waterproof connector formed on the collection unit.

Details of other embodiments are included in the detailed description and the accompanying drawings.

BRIEF DESCRIPTION OF THE DRAWINGS

The above and other objects, features, and other advantages of the present invention will be more clearly understood from the following detailed description taken in conjunction with the accompanying drawings, in which.

DETAILED DESCRIPTION OF THE INVENTION

Figure 1:
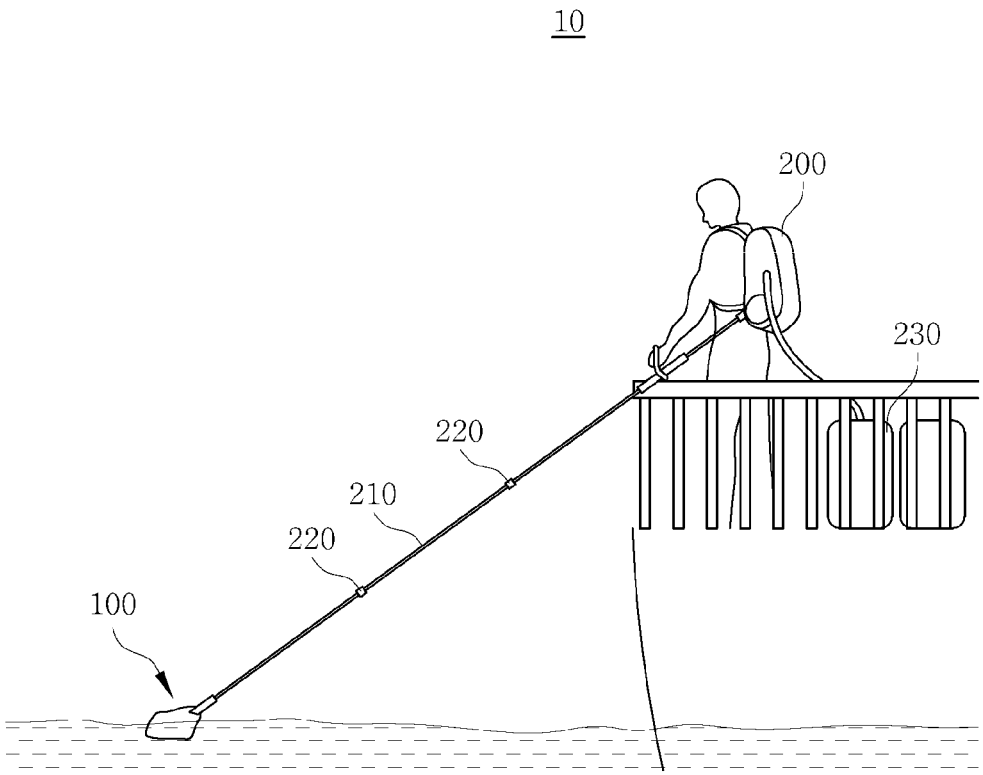
FIG. 1 is a view showing a portable oil skimmer according to an embodiment of the present invention.

Hereinafter, the embodiments disclosed in the present specification will be described in detail with reference to the accompanying drawings, and the same or similar elements are denoted by the same reference numerals even though they are depicted in different drawings, and redundant descriptions thereof will be omitted. In the following description, with respect to constituent elements used in the following description, the suffixes "module" and "unit" are used only in consideration of facilitation of description, and do not have mutually distinguished meanings or functions. In the following description of the embodiments disclosed in the present specification, a detailed description of known functions and configurations incorporated herein will be omitted when the same may make the subject matter of the embodiments disclosed in the present specification rather unclear. In addition, the accompanying drawings are provided only for a better understanding of the embodiments disclosed in the present specification and are not intended to limit the technical ideas disclosed in the present specification. Therefore, it should be understood that the accompanying drawings include all modifications, equivalents, and substitutions within the scope and sprit of the present invention.

It will be understood that although the terms "first", "second", etc., may be used herein to describe various components, these components should not be limited by these terms. These terms only used to distinguish one component from another component.

It will be understood that when a component is referred to as being "connected to" or "coupled to" another component, it may be directly connected to or coupled to another component, or intervening components may be present. On the other hand, when a component is referred to as being "directly connected to" or "directly coupled to" another component, there are no intervening components present.

As used herein, the singular form is intended to include the plural forms as well, unless the context clearly indicates otherwise.

It will be further understood that the terms "comprises", "comprising", "includes", and/or "including", when used herein, specify the presence of stated features, integers, steps, operations, elements, components, or combinations thereof, but do not preclude the presence or addition of one or more other features, integers, steps, operations, elements, components, or combinations thereof.

FIG. 1 is a view showing a portable oil skimmer according to an embodiment of the present invention.

When an oil spill accident occurs in the ocean, it is necessary to quickly collect the spilled oil in order to prevent the spilled oil from spreading to the surroundings. To this end, various types of oil skimmers are used. In the case of an oil skimmer having a large volume and a complicated structure, it takes a considerable amount of time to set up such an oil skimmer. Therefore, development of a portable oil skimmer capable of preventing the spread of oil within a short time is required.

Referring to the drawing, a portable oil skimmer 10 according to an embodiment of the present invention enables a worker to quickly move to an accident area and to perform an oil-collecting task using a collection unit configured to collect spilled oil while floating on the surface of the ocean. The portable oil skimmer 10 may include a collection unit 100 and a backpack 200.

The collection unit 100 may collect spilled oil while floating on the surface of the ocean.

The backpack 200 may be configured to enable a worker to perform a task of collecting spilled oil while wearing the same. In an alternative embodiment, the worker may perform an oil-collecting task in a state of placing the backpack 200 on a ship, rather than wearing the same. The backpack 200 may be referred to as a support device.

The collection unit 100 and the backpack 200 may communicate with each other through a pipe 210. The collection unit 100 may be provided on the upper end thereof with a connection portion, to which the pipe 210 is detachably coupled. The oil collected by the collection unit 100 may be conveyed to the ship via the pipe 210 and the backpack 200 by an oil pump. In some embodiments, the oil flowing through the pipe 210 may be conveyed to the backpack 200, or may be directly conveyed to a reservoir 230 provided on the ship.

The pipe 210 may be formed of carbon so that the worker can easily move the collection unit 100. The pipe 210 may be provided with a length adjustment portion 220 so as to be adjusted in overall length.

Figure 2:
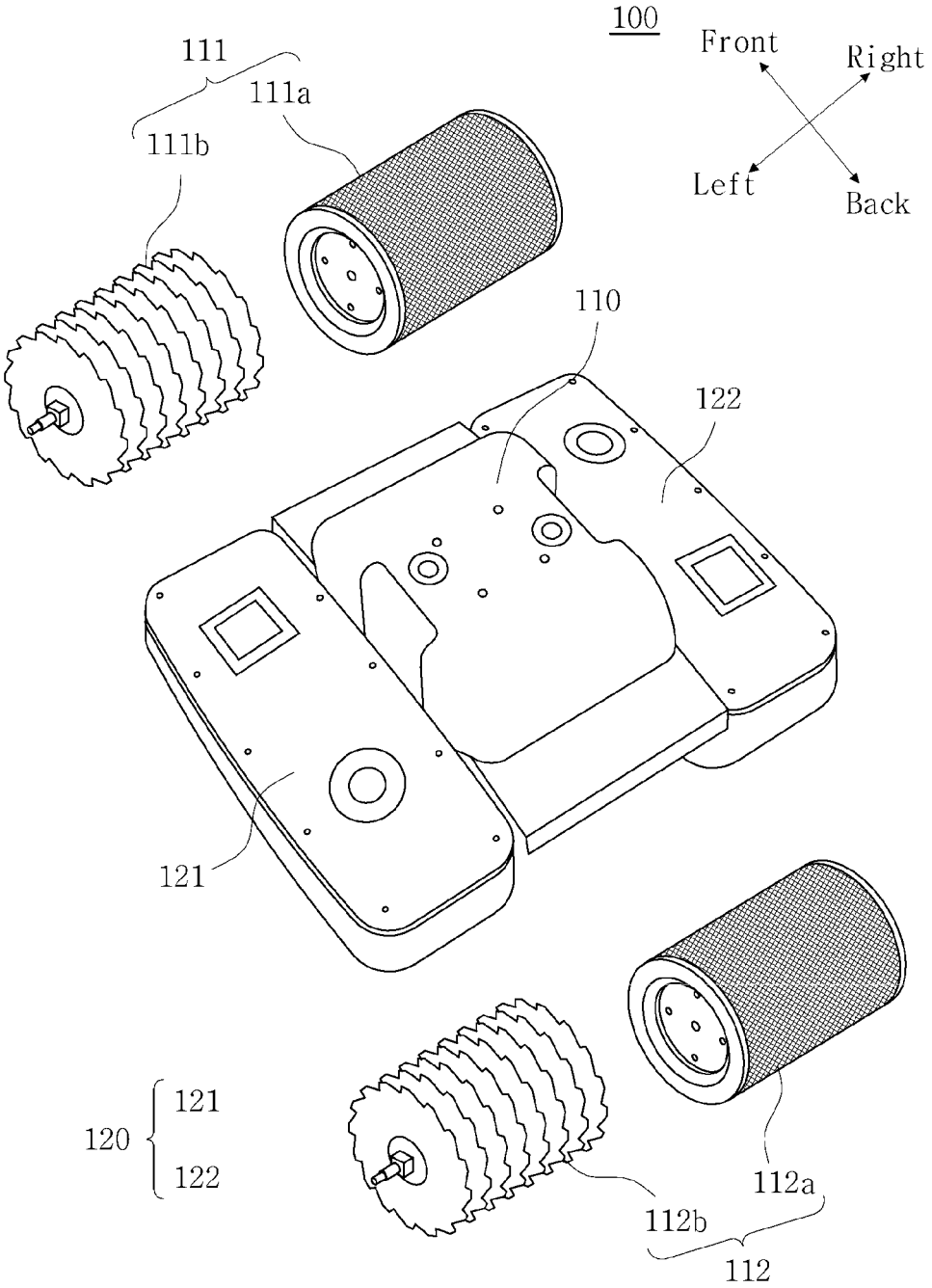
FIG. 2 is a view showing the configuration of a collection unit according to an embodiment of the present invention.

FIG. 2 is a view showing the configuration of the collection unit according to an embodiment of the present invention.

Figure 3:
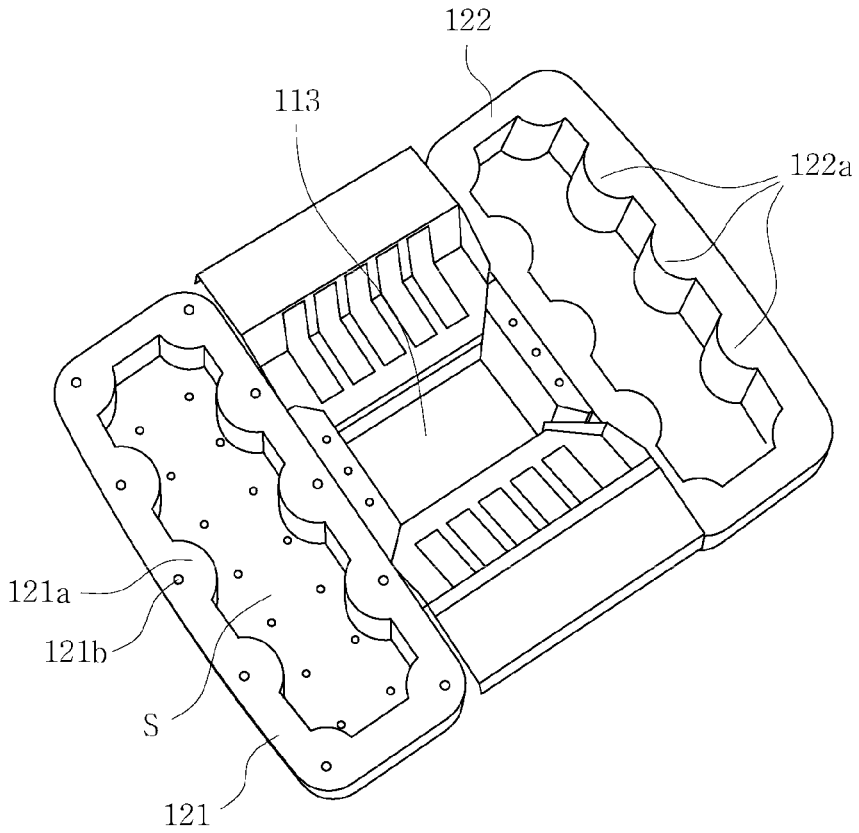
FIG. 3 is a view showing the interior of the collection unit according to an embodiment of the present invention.

FIG. 3 is a view showing the interior of the collection unit according to an embodiment of the present invention.

Figure 4:
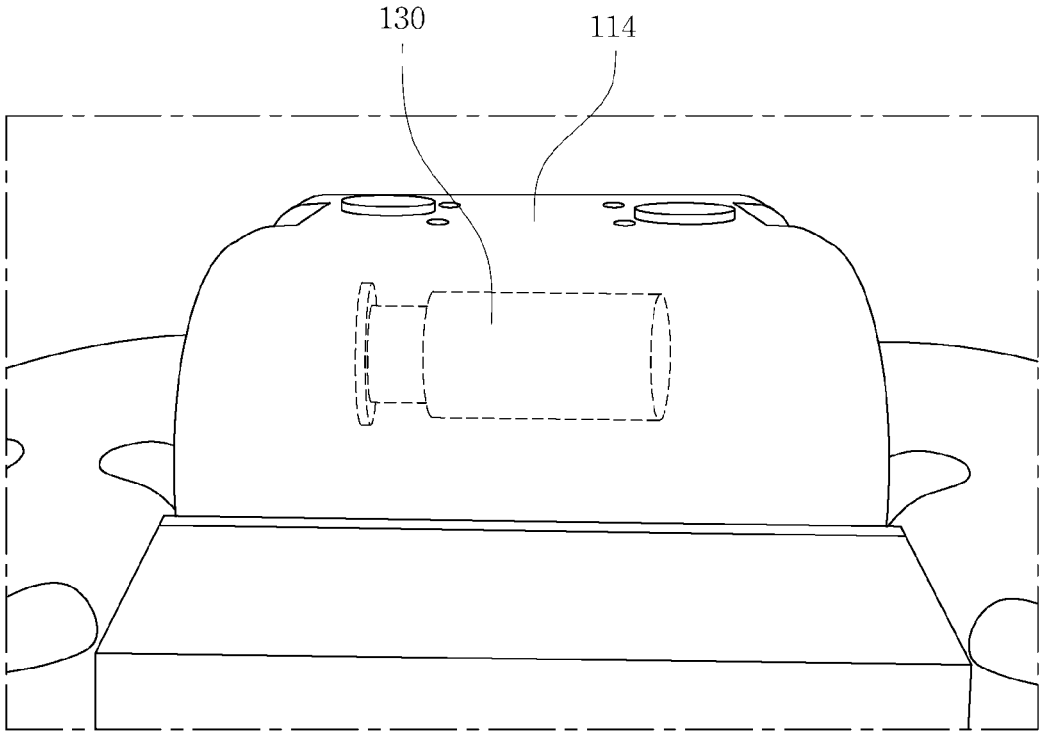
FIG. 4 is a perspective view showing the interior of the collection unit according to an embodiment of the present invention.

FIG. 4 is a perspective view showing the interior of the collection unit according to an embodiment of the present invention.

Figure 5:
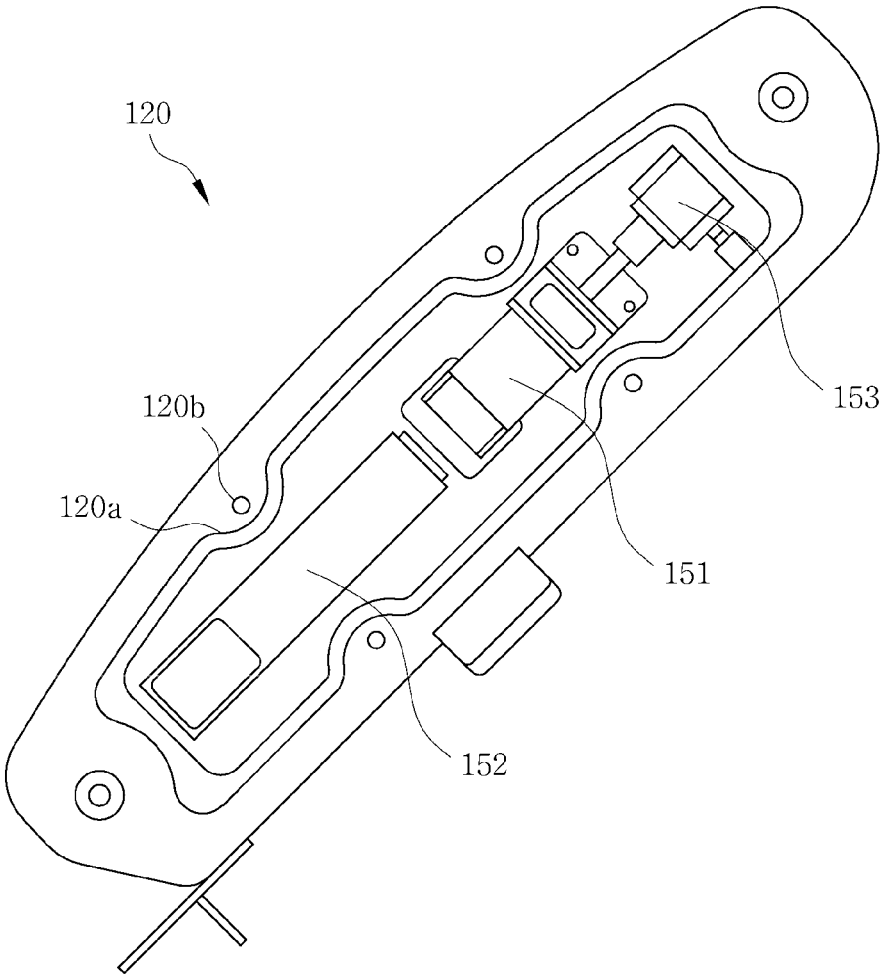
FIGS. 5 and 6 are views for explaining a first buoyant body according to an embodiment of the present invention.
Figure 6:
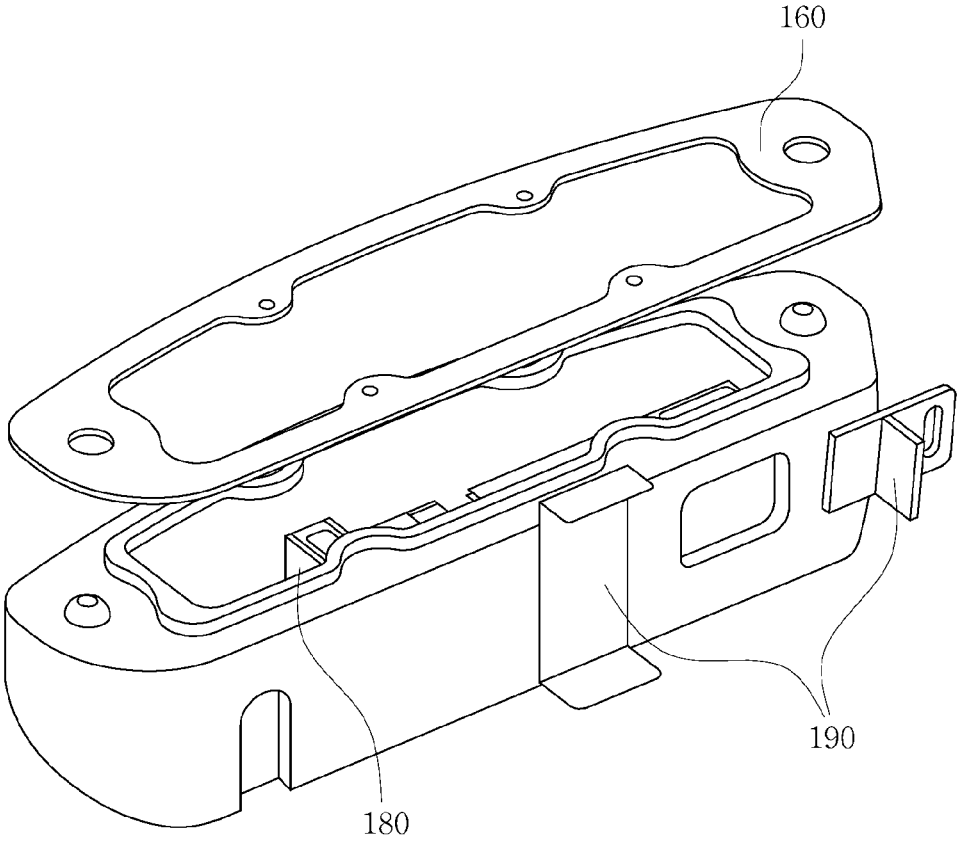

FIGS. 5 and 6 are views for explaining a first buoyant body according to an embodiment of the present invention.

Referring to the drawings, the collection unit 100 may include a main body 110, a buoyant body 120, and an oil pump 130.

The main body 110 may be configured to allow an oil-skimming member to be rotatably mounted thereto.

A first oil-skimming member 111 may be rotatably mounted to the main body 110. For example, the first oil-skimming member 111 may be rotatably mounted on the front end of the main body 110.

A second oil-skimming member 112 may be rotatably mounted to the main body 110. For example, the second oil-skimming member 112 may be rotatably mounted on the rear end of the main body 110.

Drum-type oil-skimming members 111*a* and 112*a* or disc-type oil-skimming members 111*b* and 112*b* may be selectively mounted to the main body 110 depending on an oil spill environment. The first oil-skimming member 111 and the second oil-skimming member 112 may be implemented in at least one of a disc type or a drum type, and may be formed so as to be detachably coupled to the main body 110.

The pipe 210 may be connected to an upper portion of the main body 110 so as to communicate with the interior of the main body 110. The main body 110 may include a connection portion formed on the upper portion thereof, and the pipe 210 may be coupled to or separated from the main body 110 through the connection portion. The main body 110 may be moved on the surface of the ocean by external force applied thereto through the pipe 210.

The main body 110 may include a temporary reservoir 113. The temporary reservoir 113 may store oil collected through the oil-skimming members 111 and 112. The collection unit 100 may include a scraper (not shown). While the oil-skimming members 111 and 112 rotate, the scraper may remove oil from the oil-skimming members 111 and 112 and may guide the removed oil to the temporary reservoir 113.

The buoyant body 120 may be mounted to the main body 110 to provide buoyancy to the main body 110.

The buoyant body 120 may be provided in a pair. In detail, the buoyant body 120 may include a first buoyant body 121 and a second buoyant body 122. The pair of buoyant bodies 120, i.e. the first buoyant body 121 and the second buoyant body 122, may be mounted on both side surfaces of the main body 110, with the main body 110 interposed therebetween.

The buoyant body 120 may be mounted to the main body 110 via a bracket 190.

The first buoyant body 121 may be mounted on the left surface of the main body 110.

The second buoyant body 121 may be mounted on the right surface of the main body 110.

The first buoyant body 121 and the second buoyant body 122 may be manufactured using the same mold. The second buoyant body 122 may have the same shape as the first buoyant body 121, and may be mounted on the right surface of the main body 110 in a state of being rotated 180 degrees from the first buoyant body 121 mounted on the left surface of the main body 110 about an axis extending in an upward-downward direction.

The buoyant body 120 may include a space defined therein to receive components of a power system for operation of the oil-skimming member.

The collection unit 100 may further include a motor, a battery, and a power transmission unit.

The motor may include a first motor 151 and a second motor.

The first motor 151 may generate rotational driving force to be supplied to the first oil-skimming member 111.

The second motor may be disposed symmetrically with the first motor 151 with respect to a vertical axis and a horizontal axis. The second motor may generate rotational driving force to be supplied to the second oil-skimming member 112.

The battery may include a first battery 152 and a second battery.

The first battery 152 may supply power to the first motor 151.

The second battery may be disposed symmetrically with the first battery 152 with respect to a vertical axis and a horizontal axis. The second battery may supply power to the second motor.

The power transmission unit may include a first power transmission unit 153 and a second power transmission unit.

The first power transmission unit 153 may transmit the rotational driving force generated by the first motor 151 to the first oil-skimming member 111.

The second power transmission unit may be disposed symmetrically with the first power transmission unit 153 with respect to a vertical axis and a horizontal axis. The second power transmission unit may transmit the rotational driving force generated by the second motor to the second oil-skimming member 112.

The first motor 151, the first battery 152, and the first power transmission unit 153 may be disposed in a first space S defined in the first buoyant body 121.

The second motor, the second battery, and the second power transmission unit may be disposed in a second space defined in the second buoyant body 122.

The oil pump 130 may be disposed in the main body 110. The collection unit 110 may further include a cover portion 114 configured to cover the temporary reservoir 113. The oil pump 130 may be mounted to the cover portion 114. Accordingly, the oil pump 130 may be placed in the main body 100 by the cover portion 114 being coupled to the upper side of the temporary reservoir 113.

The oil pump 130 may convey the oil collected by the first oil-skimming member 110 and the second oil-skimming member 120 to the outside of the main body 110 through the pipe 210.

That is, the oil pump 130, which is disposed in the collection unit 100, pumps up the collected oil toward the ship. If the oil pump is located at an elevated position (e.g. a ship) and pulls up the collected oil from the surface of the ocean, there may occur a problem that the collected oil is not smoothly moved up due to an air layer in an empty hose. This problem may be solved by the configuration of the present invention in which the oil pump 130 is disposed in the collection unit 100.

In an example, the oil pump 130 may convey the collected oil to the backpack 200. In this case, the collected oil may be finally conveyed to the reservoir 230 via the backpack 200.

In another example, the oil pump 130 may directly convey the collected oil to the reservoir 230.

In some embodiments, the oil pump 130 may be disposed in the buoyant body 120. In an example, the oil pump 130 may be disposed in the first space S defined in the first buoyant body 121. In another example, the oil pump 130 may be disposed in the second space defined in the second buoyant body 122.

The first buoyant body 121 may include a plurality of protruding portions 121*a* protruding from the inner side surface thereof toward the first space S.

The first buoyant body 121 may include a lower portion, which defines the first space S having an open upper side, and an upper portion, which is coupled to the lower portion to cover the open upper side of the first space S.

The protruding portions 121*a* may be formed at positions corresponding to coupling points between the lower portion and the upper portion. The protruding portions 121*a* may protrude in a direction from grooves 121*b*, which are formed in the lower portion for coupling to the upper portion, toward the first space S.

The first motor 151 and the first battery 152 may be disposed between the plurality of protruding portions 121*a* protruding from the inner side surface of the first buoyant body 121 toward the first space S, and thus may be secured in position by the plurality of protruding portions 121*a*.

Since the first motor 151 and the first battery 152 are restrained by the plurality of protruding portions 121*a*, the first motor 151 and the first battery 152 may stably supply rotational driving force to the first oil-skimming member 111 even while the collection unit 100 moves.

The lower portion may be provided on the upper surface thereof with a rubber member 180, which protrudes upward along the periphery of the first space S, and the upper portion may be coupled to the lower portion in a state of receiving the rubber member 180 therein.

The collection unit 100 may further include a plate 160. When the lower portion and the upper portion are coupled to each other, the plate 160 may be disposed between the lower portion and the upper portion in order to improve water-tightness. The plate 160 may be formed of rubber.

The second buoyant body 122 has the same shape as the first buoyant body 121, except that the mounting direction of the second buoyant body 122 to the main body 110 is different from that of the first buoyant body 121. The description of the first buoyant body 121 may be applied to the second buoyant body 122.

The portable oil skimmer 10 according to the embodiment of the present invention may be used in the following manners. The following manners of use may be classified according to a power source that supplies power for operation of the oil-skimming members 111 and 112.

First Manner of Use

The first oil-skimming member 111 may be driven by power supplied from the first battery 152 disposed in the first buoyant body 121.

The second oil-skimming member 112 may be driven by power supplied from the second battery disposed in the second buoyant body 122.

In this way, when the first oil-skimming member 111 and the second oil-skimming member 112 are driven by power supplied from the batteries disposed in the collection unit 100, the portable oil skimmer may be used for a period of time of less than one hour, but may not be used continuously for a long time period.

Second Manner of Use

The backpack 200 may accommodate a sub-battery therein. At least one of the first oil-skimming member 111 or the second oil-skimming member 112 may be driven by power supplied from the sub-battery in a state of being electrically connected to the sub-battery via a waterproof connector formed on the collection unit 100. The sub-battery may be connected to the waterproof connector formed on the cover portion 114 of the collection unit 110 via a wire to be electrically connected to at least one of the first oil-skimming member 111 or the second oil-skimming member 112.

That is, at least one of the first oil-skimming member 111 or the second oil-skimming member 112 may be driven by power supplied from the backpack 200.

The first battery and the second battery described above may be classified as main batteries.

The second manner of use may exhibit improved continuous operation performance. When the main batteries disposed in the collection unit 100 are exhausted, the sub-battery disposed in the backpack 200 may be used, whereby the working time may be doubled.

Third Manner of Use

The backpack 200 may accommodate a converter configured to convert a type of power. The converter may convert external power supplied thereto into DC power suitable for the first oil-skimming member 111 and the second oil-skimming member 112.

At least one of the first oil-skimming member 111 or the second oil-skimming member 112 may be driven by power output from the converter in a state of being electrically connected to the converter via a waterproof connector formed on the collection unit 100. The converter may be connected to the waterproof connector formed on the cover portion 114 of the collection unit 110 via a wire to be electrically connected to at least one of the first oil-skimming member 111 or the second oil-skimming member 112.

That is, at least one of the first oil-skimming member 111 or the second oil-skimming member 112 may be driven by power supplied from the backpack 200.

The third manner of use may enable continuous supply of power, thereby greatly increasing the continuous working time.

Figure 7:
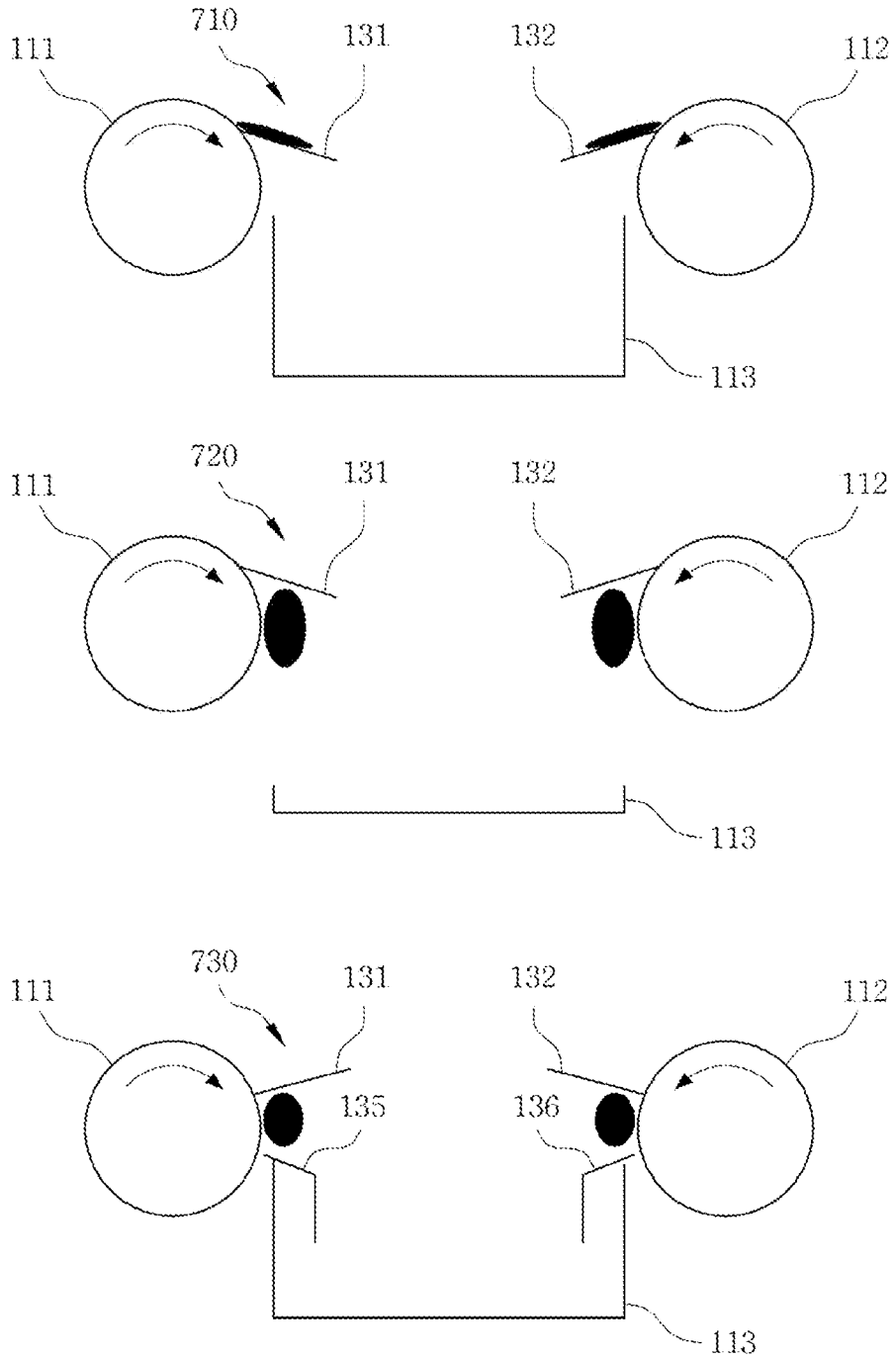
FIG. 7 is a view for explaining oil-skimming operation by rotation of a drum according to an embodiment of the present invention.

FIG. 7 is a view for explaining oil-skimming operation by rotation of a drum according to an embodiment of the present invention.

Referring to the drawing, the oil skimmer 10 may collect oil according to a first mode or a second mode.

The rotational directions of the first drum 111 and the second drum 112 may be determined depending on the first mode and the second mode, which are classified according to the type of spilled oil.

The first mode may be defined as a mode for collecting oil having so low a viscosity as to form an oil film. The second mode may be defined as a mode for collecting solidified oil due to high viscosity thereof or microplastic particles.

In the first mode 710, the first drum 111 and the second drum 112 may rotate in a direction from the outside of the collection unit 100 toward the inside of the collection unit 100. The first mode 710 may be performed to collect oil having a low viscosity.

When the first mode is selected, the first drum 111 and the second drum 112 may collect at least one of bunker fuel oil A, light oil, kerosene, lubricating oil, or floating chemicals while rotating in a direction from the outside of the collection unit 100 toward the inside of the collection unit 100.

In the first mode, the first drum 111 and the second drum 112 may rotate more slowly than in the second mode.

If the first drum 111 and the second drum 112 rotate at a high speed in the first mode, a starvation phenomenon may occur. High-speed rotation of the first drum 111 and the second drum 112 causes flow of water. Accordingly, a water hole is formed around the first drum 111 and the second drum 112, thus deteriorating oil collection performance.

In order to prevent the starvation phenomenon, the first drum 111 and the second drum 112 need to be rotated at a low speed in the first mode. The rotations per minute (RPM) of the first drum 111 and the second drum 112 in the first mode may be less than that in the second mode.

In the second mode 720, the first drum 111 and the second drum 112 may rotate in a direction from the inside of the collection unit 100 toward the outside of the collection unit 100. The second mode 720 may be performed to collect oil having a high viscosity.

When the second mode is selected, the first drum 111 and the second drum 112 may collect at least one of bunker fuel oil C, low sulfur fuel oil (LSFO), or microplastic particles while rotating in a direction from the inside of the collection unit 100 toward the outside of the collection unit 100.

In the second mode, the first drum 111 and the second drum 112 may rotate faster than in the first mode.

In the second mode, oil is brought to a predetermined height or more above the surface of the ocean in a state of being adhered to the first drum 111 and the second drum 112 due to the surface material and structure of the first drum 111 and the second drum 112, the rotational speed of the first drum 111 and the second drum 112, the type of oil, the viscosity of the oil, difference in density between the oil and the seawater, and the surface tension of the oil.

In order to cause the oil to be brought above the surface of the ocean using rotation of the first drum 111 and the second drum 112, the first drum 111 and the second drum 112 need to be rotated at a high speed. The RPM of the first drum 111 and the second drum 112 in the second mode may be greater than that in the first mode.

In a state of being brought above the surface of the ocean, the oil may be separated from the first drum 111 and the second drum 112 by a first scraper 131 and a second scraper 132, and then may fall into the temporary reservoir 113.

In order to more efficiently collect oil in the second mode, the collection unit 100 may further include a first oil guide member 135 and a second oil guide member 136 (refer to "730" in FIG. 7). The first oil guide member 135 and the second oil guide member 136 may be disposed so as to be spaced apart from the first drum 111 and the second drum 112, respectively. The first oil guide member 135 and the second oil guide member 136 may guide the oil separated from the first drum 111 and the second drum 112 by the first scraper 131 and the second scraper 132 to the temporary reservoir 113 using gravity.

The first oil guide member 135 and the second oil guide member 136 may be disposed below the first scraper 131 and the second scraper 132, respectively.

When viewed from the side, the first oil guide member 135 and the second oil guide member 136 may be formed to be inclined such that ends thereof facing the first drum 111 and the second drum 112 are located at a higher position than ends thereof facing the temporary reservoir 113.

Each of the first oil guide member 135 and the second oil guide member 136 may include a bent portion. Each of the first oil guide member 135 and the second oil guide member 136 may extend at a downward incline toward the temporary reservoir 113, and then may extend vertically downward from the bent portion toward the temporary reservoir 113.

Each of the first oil guide member 135 and the second oil guide member 136 may be formed in a plate shape, and may include a guide wall formed on a side surface thereof.

Figure 8:
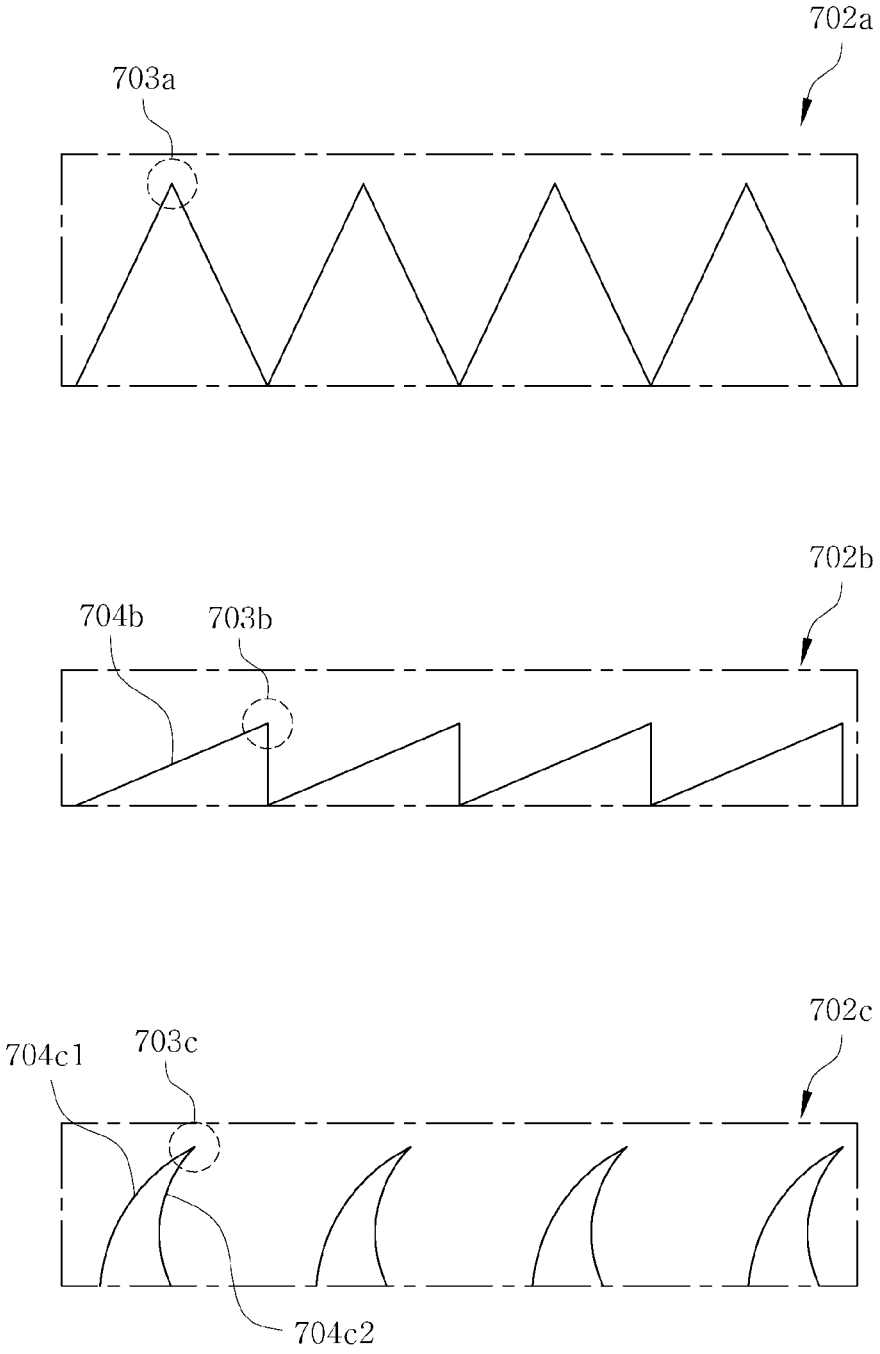
FIG. 8 is a view illustrating the cross-section of a ratchet structure according to an embodiment of the present invention.

FIG. 8 is a view illustrating the cross-section of a ratchet structure according to an embodiment of the present invention.

Referring to the drawing, the first drum 111 and the second drum 112 may employ a ratchet structure 702*a*, 702*b*, or 702*c*.

As illustrated by reference numerals 702*a* and 702*b*, the ratchet structure may have a triangular cross-section.

As illustrated by reference numeral 702*b*, the ratchet structure may have a right triangular or obtuse triangular cross-section. In this case, the area of the surface 704*b* of the ratchet structure that contacts the oil is increased, whereby not only collection of solidified oil (or LSFO) by an end portion 703*b* of the ratchet structure but also collection of high sulfur fuel oil by the surface 704*b* of the ratchet structure are possible.

As illustrated by reference numeral 702*c*, the ratchet structure may include curved surfaces having predetermined curvatures. In this case, an end portion 703*c* of the ratchet structure may be formed more pointedly, whereby efficiency of collecting solidified oil is increased. The end portion 703*c* may be a point at which a first curved surface 704*c*1 and a second curved surface 704*c*2 meet each other.

As is apparent from the above description, the present invention has the following effects.

First, since heavy components are disposed in a collection unit, the weight of a backpack to be worn by a worker is reduced, whereby work efficiency is improved, and the floating balance of the collection unit on the surface of the ocean is improved.

Second, it is possible to additionally supply power generated by a sub-power source or external power to the collection unit as needed, thereby enabling a worker to continuously perform an oil-collecting task for a long time period.

Third, since the collection unit is equipped with two oil-skimming members, oil collection efficiency per unit time is increased as the oil-collecting task is carried out.

However, the effects achievable through the invention are not limited to the above-mentioned effects, and other effects not mentioned herein will be clearly understood by those skilled in the art from the appended claims.

The present application was supported by KOREA COAST GUARD, under the programs listed below.

[Project Unique No.] 1535000288

[Project No.] 202105844

[Name of Ministry] KOREA COAST GUARD

[Research Management Institute] Korea Institute of Marine Science & Technology Promotion

[Name of Program] Development of low sulfur oil pollution control technology and equipment from marine spills

[Name of Project] Developed 3 types of oil skimmer for hydrophilic ratchet technology for LSFO recovery

[Lead Organization] KOAI CO., LTD.

[Research Period] Apr. 1, 2021-Dec. 31, 2023

The above detailed description is not intended to be construed to limit the invention in all aspects and to be considered by way of example. The scope of the present invention should be determined by reasonable interpretation of the appended claims and all equivalent modifications made without departing from the present invention should be included in the following claims.

What is claimed is:

1. A portable oil skimmer comprising:

a collection unit configured to collect spilled oil while floating on an ocean surface, wherein the collection unit comprises:

a main body configured to allow a first oil-skimming member to be rotatably mounted on a front end thereof, a second oil-skimming member to be rotatably mounted on a rear end thereof, and a pipe to be connected to an upper portion thereof so as to communicate with an interior thereof, a pair of buoyant bodies mounted on two side surfaces of the main body, with the main body interposed therebetween;

an oil pump disposed in the main body, the oil pump being configured to convey oil collected by the first oil-skimming member and the second oil-skimming member outside of the main body through the pipe;

a first motor configured to generate rotational driving force to be supplied to the first oil-skimming member;

a first battery configured to supply power to the first motor;

a first power transmission unit configured to transmit rotational driving force generated by the first motor to the first oil-skimming member, wherein the pair of buoyant bodies comprises a first buoyant body mounted on a left surface of the main body:

wherein the first motor, the first battery, and the first power transmission unit are disposed in a first space defined in the first buoyant body, wherein the first buoyant body comprises:

a plurality of protruding portions protruding from an inner side surface thereof toward the first space;

a lower portion defining the first space having an open upper side; and an upper portion coupled to the lower portion to cover the open upper side of the first space, and wherein the protruding portions protrude in a direction from grooves formed in the lower portion for coupling to the upper portion toward the first space.

2. The portable oil skimmer according to claim 1, wherein each of the first oil-skimming member and the second oil-skimming member is formed so as to be detachably coupled to the main body.

3. The portable oil skimmer according to claim 1, wherein the pair of buoyant bodies further comprises:

a second buoyant body formed to have a shape identical to a shape of the first buoyant body, the second buoyant body being mounted on a right surface of the main body in a state of being rotated 180 degrees from the first buoyant body about an axis extending in an upward-downward direction.

4. The portable oil skimmer according to claim 3, further comprising:

a second motor configured to generate rotational driving force to be supplied to the second oil-skimming member;

a second battery configured to supply power to the second motor; and a second power transmission unit configured to transmit rotational driving force generated by the second motor to the second oil-skimming member, wherein the second motor, the second battery, and the second power transmission unit are disposed in a second space defined in the second buoyant body.

5. The portable oil skimmer according to claim 1, wherein the lower portion is provided on an upper surface thereof with a rubber member, the rubber member protruding upward along a periphery of the first space, and wherein the upper portion is coupled to the lower portion in a state of receiving the rubber member therein.

6. The portable oil skimmer according to claim 1, further comprising a backpack accommodating a sub-battery therein, wherein at least one of the first oil-skimming member or the second oil-skimming member receives power from the sub-battery in a state of being electrically connected to the sub-battery via a waterproof connector formed on the collection unit.

7. The portable oil skimmer according to claim 1, further comprising a backpack accommodating a converter, wherein at least one of the first oil-skimming member or the second oil-skimming member is driven by power output from the converter in a state of being electrically connected to the converter via a waterproof connector formed on the collection unit.

* * * * *